United States Patent [19]

Spica

[11] 4,265,560

[45] May 5, 1981

[54] DISPOSABLE TOOTHBRUSH WITH SELF-CONTAINED TOOTHPASTE SUPPLY

[75] Inventor: Joseph P. Spica, Livonia, Mich.

[73] Assignee: The 2500 Corporation, Lathrup Village, Mich.

[21] Appl. No.: 34,659

[22] Filed: Apr. 30, 1979

[51] Int. Cl.[3] ..... A46B 11/02

[52] U.S. Cl. ..... 401/183; 401/192; 401/275; 401/281; 15/174; 15/176

[58] Field of Search ..... 401/154, 155, 183–186, 401/192, 275, 194, 281; 15/173, 174, 176

[56] References Cited

U.S. PATENT DOCUMENTS

| | | | |
|---|---|---|---|
| 1,045,552 | 11/1912 | Holtzman | 15/176 |
| 1,137,651 | 4/1915 | Metivier | 132/84 D |
| 2,026,832 | 1/1936 | Henderson | 401/194 |
| 2,226,663 | 12/1940 | Hill | 401/194 |
| 2,441,520 | 5/1948 | Ylvick | 401/183 |
| 2,536,968 | 1/1951 | Tirocchi | 401/155 |
| 2,719,315 | 10/1955 | Sheehan | 15/176 |
| 3,521,795 | 7/1970 | Langhjelm | 401/176 |
| 3,521,968 | 7/1970 | Wise | 401/186 |
| 3,891,085 | 6/1975 | Boger | 401/183 |
| 3,901,838 | 8/1975 | Clendinning | 47/74 |

FOREIGN PATENT DOCUMENTS

| | | | |
|---|---|---|---|
| 1339638 | 9/1963 | France | 401/176 |
| 325380 | 3/1935 | Italy | 401/184 |
| 3543 | of 1914 | United Kingdom | 401/155 |
| 484083 | 5/1938 | United Kingdom | 401/194 |

*Primary Examiner*—Clyde I. Coughenour

*Attorney, Agent, or Firm*—Dolgorukov & Dolgorukov

[57] ABSTRACT

The specification discloses a disposable toothbrush with a self-contained toothpaste supply comprising a transparent handle section and an adjustable brush head having upstanding bristles secured thereto.

The transparent cylindrical handle section is hollow and contains the dentifrice material, which is discharged into the adjustable head section when the handle section is compressed. The quantity of discharge of the dentifrice material can be easily measured and judged by the graduation marks placed on the handle. The adjustable brush head has a discharge opening for ejecting the dentifrice material between the bristles when the cylindrical transparent handle section is compressed. The adjustable brush head is capable of being closed so that premature or accidental discharge of the dentifrice material while either in storage or in use does not occur.

8 Claims, 6 Drawing Figures

DISPOSABLE TOOTHBRUSH WITH SELF-CONTAINED TOOTHPASTE SUPPLY

The present invention relates to toothbrushes, and more specifically to an improved disposable toothbrush with self-contained toothpaste supply. The disclosed device answers a long felt need for an economical disposable toothbrush with a self-contained toothpaste supply which has the features of being able to accurately control the rate of discharge of the dentifrice material, and has the means for closing off and prohibiting the accidental discharge of the dentifrice material into and through the brush head.

A review of the prior art will indicate that there are many patents which relate to the use of a disposable toothbrush, but to the best of my knowledge, none of these have had any commercial success or acceptability by the retail consumers or the business community.

Thus, one of the objects of the present invention is to provide a disposable toothbrush with a self-contained toothpaste supply which is economical.

A further object of the present invention is to provide a disposable toothbrush with a self-contained toothpaste or dentifrice material where the discharge of the toothpaste or dentifrice material can be measured.

A further object of the present invention is to provide a disposable toothbrush with a self-contained toothpaste supply where the transparent cylindrical handle in which the toothpaste is contained can be easily removed, refilled, or replaced with a new handle once the toothpaste supply is gone.

A further object of the present invention is to provide a disposable toothbrush with a self-contained toothpaste supply where brush head can be easily removed and thrown away.

Another object of the present invention is to provide a disposable toothbrush with a self-contained toothpaste supply which has the means to prevent the premature or accidental discharge of the toothpaste or dentifrice material.

Another object of the present invention is to provide a disposable toothbrush with a self-contained toothpaste supply which has a sealing means to keep the toothpaste fresh during storage.

Still another object of the present invention is to provide a disposable toothbrush with a self-contained toothpaste supply which can be made from many different materials.

Still another object of the present invention is to provide a disposable toothbrush with a self-contained toothpaste supply which is simple, safe and convenient to use and which will give efficient and durable service.

Still another object of the present invention is to provide a disposable toothbrush with a self-contained toothpaste supply where both the toothbrush head and cylindrical transparent handle can be thrown away.

Further objects and advantages of this invention will be apparent from the following description and appended claims, reference being had to the accompanying drawings forming a part of this specification, wherein like reference characters designate corresponding parts in the several views.

STATEMENT OF PATENTABILITY

As part of the disclosure of the present invention, I wish to make the following "Statement of Patentability" under Rule 96 of the Patent and Trademark Office.

I did, prior to the preparation of this patent application, cause a search to be made concerning the patentability of my invention through the records of the U.S. Patent and Trademark Office on disposable toothbrush with a self-contained toothpaste supply, within the following classes.

The search of patentability was made in Class 15, subclasses 167 R and 167 A; and Class 132, subclasses 84 B and 84 R, and I discovered the following patents:

| | | |
|---|---|---|
| Collins | (1956) | 2,750,614 |
| Dengler | (1959) | 2,893,031 |
| Hromoko et al. | (1961) | 2,976,554 |
| Slater | (1971) | 3,609,789 |
| Boger | (1975) | 3,891,085 |
| Watson | (1975) | 3,917,420 |

After a careful review of each of the above patent references which was disclosed by the search of the Patent Office records, it is my opinion that the only patent reference which is material to the examination of the present invention would be the "Boger" patent, entitled "Tooth brush".

It is further my opinion that although the "Boger" patent is material to the examination of the present patent application, it does not anticipate my invention, and can be easily distinguished on the following grounds:

First, a review of the Boger patent discloses a disposable toothbrush, made from a flattened drinking straw, comprising a main body which is divided into a handle section and an integral brush head section. The handle section is of hollow tubular form for holding a dentifrice, and has a discharge opening therein for ejecting the dentifrice between said brush bristles when the tubular section is compressed.

The differences between my invention and the Boger toothbrush both in construction and function would be as follows, i.e.:

First, the one-piece construction of the Boger toothbrush versus the two-piece construction of Applicant's invention is a construction difference which must be considered from the utility point of view. It must be recognized that one of the most expensive parts of a toothbrush is the brush head itself.

Therefore, there would be an immediate economic advantage to have a disposable toothbrush which could reuse the brush head when the tubular, or as in my invention, the transparent cylindrical handle containing the toothpaste material was replaced or refilled.

Second, my invention can further be distinguished by the use of a novel rotating locking brush head mechanism which is capable of sealing off the toothpaste material contained in the transparent cylindrical handle when not in use. Also, the use of graduation marks on the transparent cylindrical handle which allows the controlled delivery of a desired amount of toothpaste material to the brush head when the handle is compressed is not found in "Boger". Further advantages of my invention over those disclosed in the "Boger" patent will be apparent from the specification with reference to the accompanying drawings.

It is to be understood that the present invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for purpose of description and not of limitation.

Figure 1:
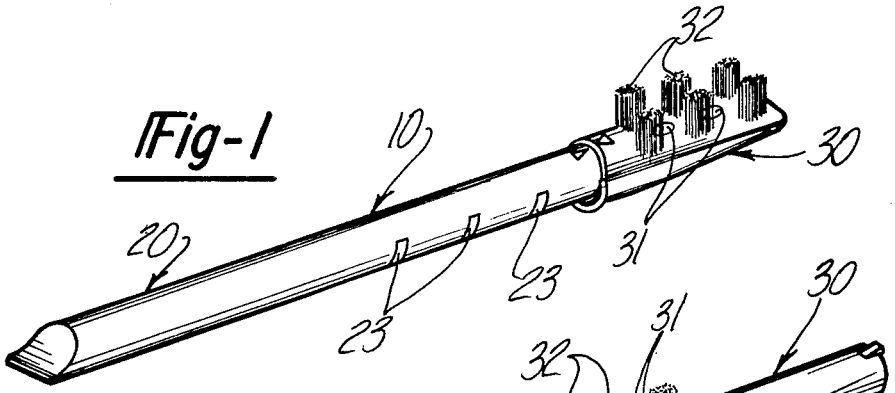
FIG. 1 is a perspective view of a construction of a disposable toothbrush with self-contained toothpaste supply embodying my invention.
Figure 2:
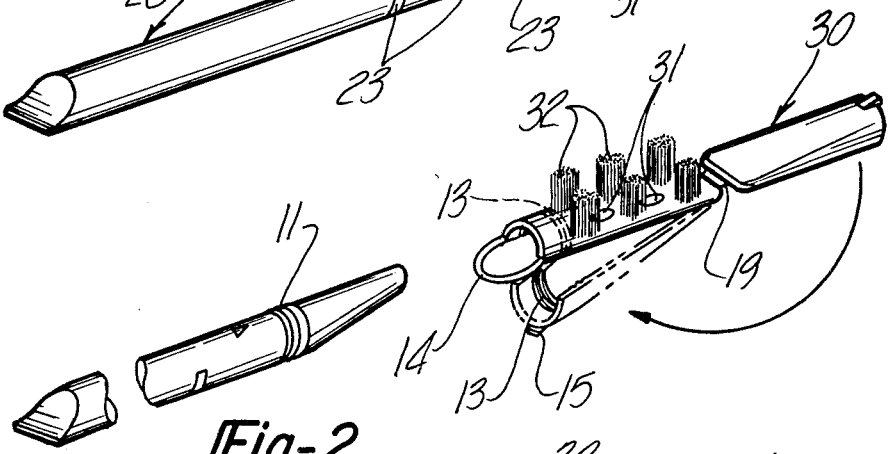
FIG. 2 is a partial perspective view of a disposable toothbrush with a self-contained toothpaste supply showing the transparent cylindrical handle with the brush head detached.

Referring to FIGS. 1 and 2, there is a perspective view of the preferred embodiment of my invention, which is generally designated by numeral 10.

The disposable toothbrush with a self-contained toothpaste supply 10, comprises a transparent cylindrical handle generally designated by the numeral 20, and an adjustable brush head generally designated by the numeral 30.

Figure 3:
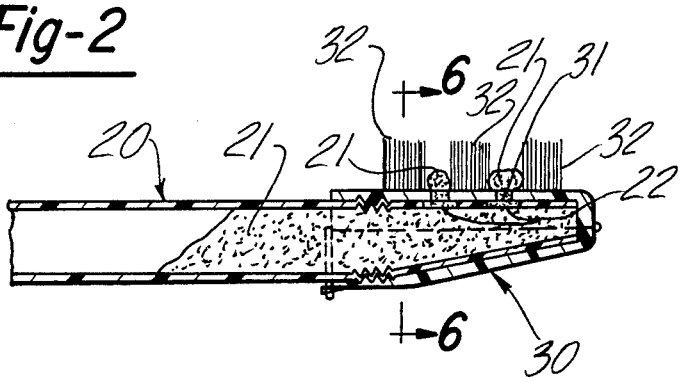
FIG. 3 is a fragmentary sectional view of the disposable toothbrush shown in FIG. 1 with a self-contained toothpaste supply as shown.

The transparent cylindrical handle 20 is hollow and contains the toothpaste 21. As best seen in FIG. 3, the toothpaste 21 is forced through the adjustable brush head 30 when the handle 20 is compressed. The toothpaste 21 leaves the transparent cylindrical handle 20, passes through the handle openings 22, and enters the discharge openings 31, provided at the top of the adjustable brush head 30 and located between the brush bristles 32.

The handle 20 is of one-piece construction, and is sealed at the handle end with handle openings 22 provided adjacent the opposite end. The transparent cylindrical handle 20 is preferably molded out of polyethylene or any other suitable low cost material or a biodegradable material.

The transparent cylindrical handle 20 is marked in a transverse direction to its longitudinal axis with graduation marks 23 which provide an easy and highly visible means of judging the amount of discharge of the toothpaste 21 during actual use, thus substantially eliminating the waste thereof.

While the transparent cylindrical handle 20 is capable of being compressed so that a displacement and discharge of the toothpaste 21 will occur, it must however, be of a sufficiently rigid strength to maintain its form and be useful as a handle.

The adjustable brush head 30 is of one-piece construction from which the brush bristles 32 depend. The bristles may either be attached to the head 30, or be molded integrally therewith. Both the adjustable brush head 30 and the brush bristles 32 are preferably molded out of a low cost polyethylene material, with the brush bristles 32 being made pliant enough to bend during use, thereby avoiding damage to the mouth tissue. The head is initially molded in two halves connected by a living hinge 19, and having a retaining ring 14 and a tab 15 which allows the head to be placed on the handle in a manner to be described.

To attach the brush head 30 to the handle 20 a plurality of recessed grooves 11 are provided in the handle and a plurality of mating grooves 13 are provided in each half of the brush head 30. The brush head is folded in half and the retaining ring pushed downwardly. The retaining head 34 fits into the groove 36 to provide a seal, thus forming a completed brush head 30. The handle 20 is then fed through the ring 14 and into the head 30, until it has gone as far as it can, at which time all of the recessed grooves 11 are engaged by a mating groove 13 to provide a strong connection between the brush head 30 and the handle 20 but also one which allows for the rotation of the head. The ring 14 is now snapped over tab 16 which locks the handle 20 into the head 30. The assembled toothbrush is then shown in FIG. 3. If desired, a stop (not shown) could be formed in the handle 11 which would be adapted to butt up against the tab 15 and stop the rotation of the brush head 30 after a predetermined number of degrees.

Whether or not the additional stop means is provided, my invention provides for the opening and closing of the discharge openings 31 by the rotation of the handle 20.

Figure 4:
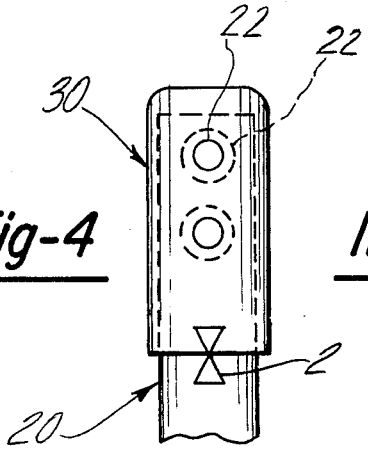
FIG. 4 is a fragmentary plan view of the head section of the disposable toothbrush with self-contained toothpaste supply where the head section is rotated to an open position.
Figure 5:
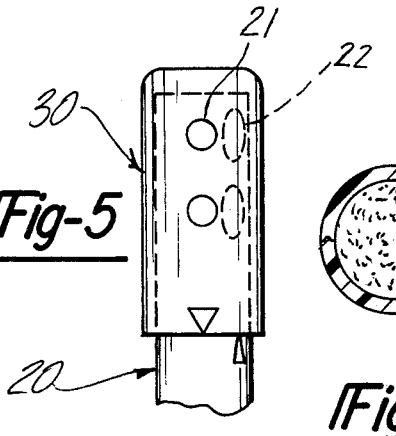
FIG. 5 is a fragmentary plan view of the head section of the disposable toothbrush with self-contained toothpaste supply where the head section is rotated to a closed position.
Figure 6:
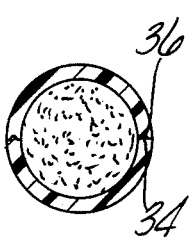
FIG. 6 is a sectional view taken in the direction of the arrows on the section line 6—6 of FIG. 3.

This feature can be best seen by referring to FIGS. 4 and 5, where FIG. 4 shows the adjustable brush head 30 in an open position in that both the circular handle openings 22 and the discharge openings 31 are concentrically lined up to permit the discharge of the toothpaste 21 when the transparent cylindrical handle 20 is compressed. While FIG. 5 shows the circular handle openings 22 and the discharge opening 31 in a non-aligned position, therefore preventing the discharge of the toothpaste 21 when the toothbrush is stored.

The alignment of the handle openings 22 and the discharge openings 31 is easily determined by the matching of the reference triangles 12 located on the ends of both the transparent cylindrical handle 20 and the adjustable brush head 30.

While I have described my invention as holding and dispensing toothpaste for dental hygiene uses, it should be understood that it is well within the scope of the present invention that my device be used to hold and dispense a wide variety of other materials and be used, therefore, for many purposes other than dental hygiene, such as dispensing cleaning fluids, lubricants, polishes, paints and the like.

Thus, by abandoning the previous construction of disposable toothbrushes, the problems of drying out and waste of the dentifrice material has been eliminated by my invention.

I claim:

1. A disposable toothbrush with a self-contained toothpaste supply including a flexible hollow cylindrical handle having a closed end and an open flexible end, said open flexible end adapted to assume a conical shape upon insertion into a brush head, said flexible end having at least one handle opening in the wall thereof, dentifrice material stored in said cylindrical handle and adapted to be discharged through said handle opening, a hollow snap on adjustable brush head having bristles depending therefrom and having at least one discharge opening therein adapted to be aligned directly opposite said handle opening, and means to rotatably attach said adjustable brush head to said cylindrical handle, wherein said adjustable brush head is of a one-piece construction having two halves connected by a living hinge, one of said halves having bristles depending therefrom and having at least one discharge opening therein adapted to be aligned with said handle opening, a retaining ring formed integrally with one of said halves, and the other half of said adjustable brush head having a tab member depending therefrom, all adapted when closed to provide an adjustable brush head having an opening complimentary in shape to said cylindrical handle, and adapted when closed, and said retaining ring is placed over said tab, to cause a rotatable but sealing connection between said adjustable brush head and said transparent cylindrical handle.

2. The device defined in claim 1, wherein said means for rotatably attaching said adjustable brush head to said hollow cylindrical handle includes a plurality of recessed grooves provided on said hollow cylindrical handle and a plurality of mating grooves provided on the interior wall of said adjustable brush head all adapted to aid said sealing connection between said adjustable brush head and said cylindrical handle.

3. The device defined in claim 2, wherein said cylindrical handle is transparent and has graduation marks placed thereon transverse to the longitudinal axis of said handle.

4. The device defined in claim 3, wherein said transparent cylindrical handle is of one-piece construction.

5. The device defined in claim 4, wherein reference triangles are placed on both the transparent cylindrical handle and the adjustable brush head in such a relationship that when said marks are lined up the handle openings and the discharge openings will be aligned, thereby allowing the discharge of the dentifrice material when said transparent cylindrical handle is compressed.

6. The device defined in claim 5, wherein said adjustable brush head and said transparent cylindrical handle are made of a biodegradable polyethylene material.

7. The device defined in claim 6, wherein said dentifrice material contained within said hollow transparent cylindrical handle is toothpaste.

8. The device defined in claim 1, and adapted to hold and to discharge a variety of materials other than toothpaste for a variety of uses other than dental hygiene.

* * * * *